United States Patent [19]

Miyakawa

[11] 4,067,384

[45] Jan. 10, 1978

[54] HEAT EXCHANGER CORE ASSEMBLY FOR ENGINE COOLING SYSTEM

[76] Inventor: Gene K. Miyakawa, 4209 N. Cutler Ave., Baldwin Park, Calif. 91706

[21] Appl. No.: 697,136

[22] Filed: June 17, 1976

[51] Int. Cl.[2] ..... F28D 1/04; F28F 1/32; F28F 13/08

[52] U.S. Cl. ..... 165/151; 165/172

[58] Field of Search ..... 165/151, 44, 124, 172, 165/175, 173

[56] References Cited

U.S. PATENT DOCUMENTS

| | | | |
|---|---|---|---|
| 1,138,367 | 5/1915 | Farlinger | 165/151 |
| 1,752,879 | 4/1930 | Anderson | 165/151 |
| 2,055,549 | 9/1936 | Modine | 165/151 |
| 3,149,667 | 9/1964 | Astrup | 165/151 |
| 3,885,936 | 5/1975 | Limebeer | 165/172 |

FOREIGN PATENT DOCUMENTS

| | | | |
|---|---|---|---|
| 1,313,973 | 4/1973 | United Kingdom | 165/151 |

*Primary Examiner*—Charles J. Myhre
*Assistant Examiner*—Sheldon Richter
*Attorney, Agent, or Firm*—Sellers and Brace

[57] ABSTRACT

A heat exchanger core assembly suitable for use in a motor vehicle and the like cooling system. The assembly has a multiplicity of parallel heat transfer fins pierced by a large number of liquid-filled tubes to be cooled. The leading edges of the fins are overturned to provide venturi-shaped inlets for the cooling air effective to increase the air flow velocity over the fins. These overturned edges have an outer broad surface lying in a plane normal to the air passages which surface is readily cleared of insects unable to enter the venturi throat.

3 Claims, 3 Drawing Figures

HEAT EXCHANGER CORE ASSEMBLY FOR ENGINE COOLING SYSTEM

This invention relates to heat exchangers, and more particularly to an improved high efficiency finned core assembly having the entrance edges thereof formed to provide venturi passages lying in a common plane to enhance the velocity of the air flow and to prevent the entrance of larger insects.

It is well known that present day vehicle engines impose heavy heat dissipating loads on the air cooled heat exchanger or radiator. This efficiency is oftentimes greatly impaired by insects which become impaled upon the leading edges of the core fins or trapped in the narrow air passages between the fins. The hot surfaces quickly dry the crushed insects on the metal surfaces and it can be an irksome and frustrating task to remove the remains with the result that efforts to do so invariably deforms the fins causing blockage to air flow that can be more severe than the presence of the insects.

Various proposals have been made heretofore to increase the operating efficiency of radiator units but all fail to utilize the structural and operating principles of this invention and are inferior thereto in performance. For example, Anderson U.S. Pat. No. 1,752,879 proposes overturning both the leading and trailing edges of his heat transfer fins and staggering the edges of adjacent pairs of fins for the purpose of minimizing the air flow resistance. Modine U.S. Pat. No. 2,055,549 is a further example of the prior art wherein it is proposed to taper in the thickness of the fins from a maximum along the air inlet edge thereby to increase flow efficiency by providing more flow area as the air temperaturerises during passage through the radiator. Neither of these prior constructions include any means for increasing the flow velocity of air in contact with the fin surface nor any means for trapping insects or for expediting or facilitating their removal.

The foregoing and other shortcomings and disadvantages of prior fin-equipped heat exchangers are avoided by the present invention wherein the leading edges of the heat exchange fins are overturned and shaped to cooperate with one another to provide a multiplicity of venturi-shaped air inlet slots. These slots function to very substantially increase the velocity of the air flow throughout its passage across the fins. This higher velocity flow increases the effectiveness of the heat exchange between the air and the fin surfaces. Desirably, major portions of the overturned leading edges of the fins lie in a common plane generally normal to the axis of the air passages and this feature taken in combination with the narrow throats of the venturi slots permits only smaller insects to enter the air passages. Any insects which can enter are readily carried through and discharged from the air passages, whereas larger insects impinge upon the flat surfaces of the overturned edges or lodge across and bridge the venturi throats. These insects are easily removed without risk of damage to the edges of the fins which are amply reinforced by their tubular shape.

Accordingly, it is a primary object of this invention to provide an improved, more efficient finned heat exchanger core assembly having the leading edges of the fins reinforced and shaped to provide venturi passages to increase the velocity of the air flow through the exchanger and to bar the entrance of all except very small insects.

Another object of the invention is the provision of an improved fin-type heat exchanger particularly suitable for use in the cooling system of a vehicle engine and having the leading edges of its cooling fins shaped to increase the velocity of the air passing through the exchanger and to trap and facilitate the removal of insects present in the air stream.

These and other more specific objects will appear upon reading the following specification and claims and upon considering in connection therewith the attached drawing to which they relate.

Referring now to the drawing in which a preferred embodiment of the invention is illustrated:

Figure 1:
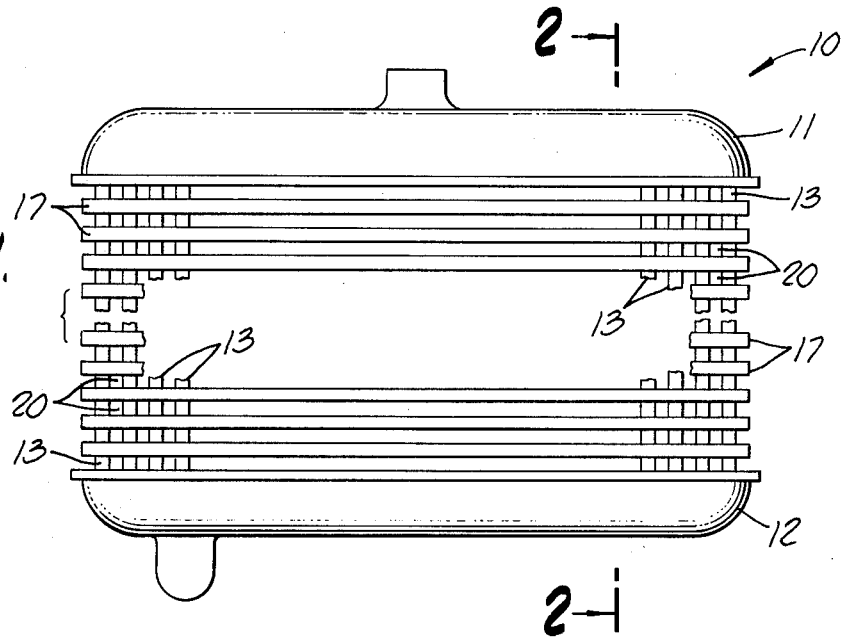
FIG. 1 is a front elevational view of a heat exchanger core incorporating features of the invention and showing a portion only of the core tubes.
Figure 2:
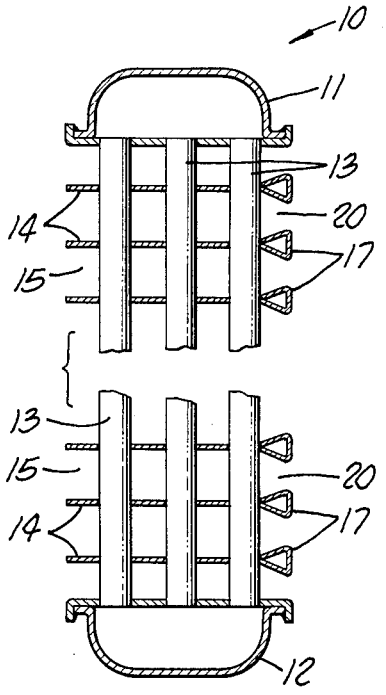
FIG. 2 is a cross-sectional view taken along line 2—2 on FIG. 1.

Referring more particularly to FIGS. 1 and 2, there is shown an illustrative embodiment of the invention core assembly designated generally 10. This assembly has upper and lower liquid headers 11, 12 in communication with one another through a multiplicity of vertical tubes 13. It will be understood that tubes 13 may be round or of elliptical cross-section with their longer axis aligned with the direction of air flow through the core. Assembled and preferably bonded to tubes 13 are a plurality of parallel spaced-apart fins 14 providing cooling air passages 15. All components of the core are preferably of good heat conducting material.

Figure 3:
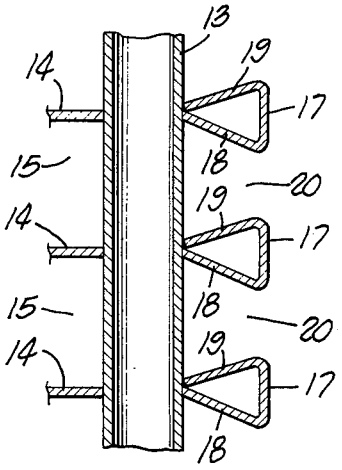
FIG. 3 is a fragmentary cross-sectional view on an enlarged scale showing details of the leading edges of the core fins.

The leading edges of fins 14 are overturned and folded back upon themselves in a manner best shown in FIGS. 2 and 3. As there shown, the overturned edges are of equilateral triangular shape in cross-section with one side 17 of each lying in a common plane normal to the portion of the fins. The sides or surfaces 18 and 19 of the overturned edges converge toward the trailing edges of the fins and cooperate with the similar surfaces of adjacent fins to form venturi slots or passages 20 each associated and discharging into a respective one of the cooling air passages 15. The width of the venturi throats is not illustrated to scale and may vary. Typically a width of approximately $\frac{1}{8}$ to 3/16 inches is found to provide excellent results both as respects increasing the air flow velocity and trapping insects and airborne debris.

It will be understood that headers 11, 12 are connected in circuit with the fluid to be cooled, such as the liquid cooling circuit of a vehicle engine with the core assembly 10 customarily extending crosswise of the front of the vehicle and the leading edges of fins 14 foremost and facing the direction of vehicle travel. Customarily a power driven air fan is mounted immediately rearwardly of the trailing core assembly and aids in pulling cooling air therethrough. The cooling air enters the venturi slots 20 which function in known manner to very substantially increase the air velocity throughout the cooling passages 15. These throats are sufficiently narrow to trap all but the smallest insects oftentimes present in the air and all other insects are either diverted around the radiator or become impaled upon the flat surfaces 17 or in some instances bridge and become trapped crosswise of throats 20. Those that do pass through the throat are readily carried through the core without lodging upon the fin surfaces. Those insects which remain trapped at the entrance to the air passages are easily and readily removed by a stiff-bristled brush or by a broad bladed tool bridging several of the overturned leading edges of the fins.

While the particular heat exchanger core assembly for engine cooling system herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. In a heat exchanger core assembly of the type having a multiplicity of cooling medium tubes arranged in spaced apart parallel relation between a pair of headers and piercing a multiplicity of heat conductive fins arranged in spaced apart parallel relation in good heat conducting intimacy to each of said tubes and cooperating to provide air flow passages crosswise of said tubes, that improvement which comprises: enlargements extending lengthwise of and restricted to the leading edges of said fins along the air inlets to said air flow passages, said enlargements cooperating with one another to form venturi-shaped air inlets into said air flow passages lying in a common plane at the air entrance of said air flow passages and effective to increase the velocity of air flow and the heat exchange between said tubes, fins and the air, and the portions of said air flow passages inwardly of said venturi shaped air inlets and between said cooling medium tubes being imperforate, parallel to one another and free of air flow disturbing obstructions.

2. A heat exchanger core assembly as defined in claim 1 characterized in that said enlargements along the edges of said fins are generally triangular in cross-section with the portions of adjacent fins cooperating to form a narrow slip-like throat.

3. A heat exchanger core assembly as defined in claim 1 characterized in that the edges of said fins at the air inlets to said air flow passages are overturned parallel to the fin edge to provide a return bend of generally equilateral triangular shape with one side wall thereof lying outermost and in a plane generally normal to said fins, adjacent ones of said overturned edges cooperating to form venturi passages to increase the velocity of the air therethrough and effective to block the entrance of insects which are held captive at the entrance to the venturiis and are readily removed therefrom.

* * * * *